US006372420B1

(12) United States Patent
Miki et al.

(10) Patent No.: US 6,372,420 B1
(45) Date of Patent: Apr. 16, 2002

(54) METHOD FOR PRODUCING SILVER HALIDE PHOTOGRAPHIC EMULSION

(75) Inventors: Masaaki Miki; Hirokazu Saito, both of Minami-Ashigara (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 0 days.

(21) Appl. No.: 09/533,989

(22) Filed: Mar. 24, 2000

(30) Foreign Application Priority Data

Mar. 25, 1999 (JP) ..... 11-082332

(51) Int. Cl.[7] ..... G03C 1/005
(52) U.S. Cl. ..... 430/569; 430/567
(58) Field of Search ..... 430/567, 569

(56) References Cited

U.S. PATENT DOCUMENTS 5,104,786 A 4/1992 Chronis et al.
5,166,015 A * 11/1992 Ichikawa et al. ..... 430/30
5,484,697 A * 1/1996 Mignot et al. ..... 430/569
6,048,906 A * 4/2000 Ernst et al. ..... 516/77
6,096,495 A * 8/2000 Kasai et al. ..... 430/569

FOREIGN PATENT DOCUMENTS

JP 8334848 12/1996

* cited by examiner

*Primary Examiner*—Janet Baxter
*Assistant Examiner*—Amanda C. Walke
(74) *Attorney, Agent, or Firm*—Birch, Stewart, Kolasch & Birch, LLP

(57) ABSTRACT

Disclosed is a method for producing a silver halide photographic emulsion comprising turning at least one of an aqueous solution of a silver salt and an aqueous solution of a halide into a linear jet stream having a high flow rate, and mixing the two kinds of solutions with each other for a short time, thereby continuously forming silver halide grains.

36 Claims, No Drawings

METHOD FOR PRODUCING SILVER HALIDE PHOTOGRAPHIC EMULSION

FIELD OF THE INVENTION

The present invention relates to a method for producing a silver halide photographic emulsion.

BACKGROUND OF THE INVENTION

The production of silver halide photographic emulsions is usually carried out by adding silver ions and halide ions into reaction vessels equipped with stirrers. Nucleation occurs by initial addition, and crystal growth is performed by subsequent addition. Stirring methods include various methods, for example, as described in JP-A-7-219092 (the term "JP-A", as used herein means an "unexamined published Japanese patent application"), JP-A-8-171156, JP-A-4-283741, JP-B-8-22739 (the term "JP-B" as used herein means an "examined Japanese patent publication") and U.S. Pat. No. 3,782,954. However, when nucleation is conducted by such methods, nucleation and nuclear growth occur in parallel even by any of these stirring methods, because solutions circulate in reaction vessels. It is therefore difficult to form monodisperse nuclei.

In the field of silver halide photography, tabular silver halide grains having large light-receiving areas have been widely used as light-sensitive elements. For increasing the light-receiving efficiency, thin tabular silver halide grains are preferred. However, according to the methods as described above, the tabular silver halide grains in the course of growth pass through a high supersaturation region in the vicinity of an opening for adding silver ions or halide ions to cause the harmful effect that the tabular grains are increased in thickness.

For solving these problems, there is a method of providing an external mixer in addition to the reaction vessel, forming fine silver halide grains with the external mixer, and using them in the nucleation stage or the growth stage. According to this method, an aqueous solution of a silver salt, an aqueous solution of a halide and an aqueous solution of a dispersing medium are added to the external mixer to continuously form fine grains. The fine grains can be used for nucleation and/or growth. In such a method, it is desired that the mixer can completely mix the added solutions for as short a time as possible. It is unfavorable that a long time is taken for mixing, or that the added solutions circulate in the external mixer.

As the reaction vessels, various type ones can be used. For example, in U.S. Pat. No. 5,250,403 and JP-A-10-43570, mixing is performed with an agitating blade in a small-volume mixer. However, in such a method, the added solutions circulate in the mixer.

In JP-A-4-139440 and PCT International Publication JP-A-6-507255, mixing is performed without mechanical stirring, so that there is no circulation of the added solutions. In this method, however, the mixing power is insufficient because of absence of stirring.

For maintaining the sufficient mixing power without mechanical stirring, there is a method of turning the added solutions into jet streams, and conducting mixing by their kinetic energy. JP-A-8-334848 discloses a method for producing a silver halide photographic emulsion utilizing kinetic energy of such jet streams. However, the patent is directed to a method for producing a silver halide photographic emulsion by the single jet process, and utterly different from a method using the external mixer. Further, the kinetic energy used herein is insufficient for mixing the whole contents of the reaction vessel, so that mechanical stirring is used in combination.

SUMMARY OF THE INVENTION

It is therefore an object of the present invention to provide a method for producing a silver halide photographic emulsion, which can continuously form small-sized and monodisperse silver halide grains. Another object of the present invention is to obtain monodisperse silver halide grains by using the above silver halide photographic emulsion as nuclei. A further object of the present invention is to make it possible to form thin tabular silver halide grains by using the above silver halide photographic emulsion for crystal growth.

The objects of the present invention are attained by the following:

(1) A method for producing a silver halide photographic emulsion comprising turning at least one of an aqueous solution of a silver salt and an aqueous solution of a halide into a linear jet stream having a high flow rate, and mixing the two kinds of solutions with each other for a short time, thereby continuously forming silver halide grains;

(2) A method for producing a silver halide photographic emulsion comprising turning at least one of an aqueous solution of a silver salt and an aqueous solution of a halide into a linear jet stream having a high flow rate, and mixing the two kinds of solutions with each other without their circulation, thereby continuously forming silver halide grains;

(3) A method for producing a silver halide photographic emulsion comprising turning at least one of an aqueous solution of a silver salt and an aqueous solution of a halide into a linear jet stream having a high flow rate, and mixing the two kinds of solutions with each other without mechanical stirring, thereby continuously forming silver halide grains;

(4) A method for producing a silver halide photographic emulsion comprising turning at least one of an aqueous solution of a silver salt and an aqueous solution of a halide into a linear jet stream having a high flow rate, and passing the two kinds of solutions through a capillary parallel to the jet stream and having recesses on the inside thereof to mix them with each other for a short time, thereby continuously forming silver halide grains;

(5) A method for producing a silver halide photographic emulsion comprising turning at least one of an aqueous solution of a silver salt and an aqueous solution of a halide into a linear jet stream having a high flow rate, and passing the two kinds of solutions through a capillary parallel to the jet stream and having recesses on the inside thereof to mix them with each other without their circulation, thereby continuously forming silver halide grains; and (6) A method for producing a silver halide photographic emulsion comprising turning at least one of an aqueous solution of a silver salt and an aqueous solution of a halide into a linear jet stream having a high flow rate, and passing the two kinds of solutions through a capillary parallel to the jet stream and having recesses on the inside thereof to mix them with each other without mechanical stirring, thereby continuously forming silver halide grains.

DETAILED DESCRIPTION OF THE INVENTION

In the invention, an aqueous solution of silver nitrate is usually used as the aqueous solution of the silver salt. When the silver halide grains obtained in the method of the present invention are used as nuclei, the concentration of the aqueous solution is preferably 4 mol/liter or less, more preferably 1 mol/liter or less, and most preferably 0.2 mol/liter or less. When the grains are used for crystal growth, the use of an aqueous solution having a high concentration is preferred from the viewpoint of productivity. The concentration thereof is preferably from 0.5 mol/liter to 4 mol/liter, and more preferably 1.0 mol/liter or more. The temperature of the aqueous solution is preferably from 5° C. to 75° C.

The aqueous solutions of the halides usually used in the present invention include aqueous solutions of potassium bromide, sodium bromide, potassium chloride, sodium chloride, potassium iodide, sodium iodide and mixtures thereof. When the silver halide grains obtained in the method of the present invention are used as nuclei, the concentration of the aqueous solution is preferably 4 mol/liter or less, more preferably 1 mol/liter or less, and most preferably 0.2 mol/liter or less. When the grains are used for the crystal growth, the use of an aqueous solution having a high concentration is preferred from the view point of productivity. The concentration thereof is preferably from 0.5 mol/liter to 4 mol/liter, and more preferably 1.0 mol/liter or more. The temperature of the aqueous solution is preferably from 5° C. to 75° C.

It is preferred that at least one of the aqueous solution of the silver salt and the aqueous solution of the halide used in the present invention contains gelatin as a protective colloid. Gelatin has a significant effect on the frequency of the occurrence of twin crystals in the silver halide grains formed, so that the preferred concentration of an aqueous solution of gelatin varies depending on the purpose for use of the fine silver halide grains formed.

When the silver halide grains continuously formed are used as nuclei in preparing tabular silver halide grains, parallel double twin crystal nuclei are necessary. It is therefore necessary that the concentration of the aqueous solution of gelatin is adjusted so as to achieve the desired frequency of the occurrence of twin crystals. The gelatin concentration is preferably selected so as to give a gelatin amount of 0.03 g to 0.4 g, more preferably 0.3 g or less, per gram of silver, when the aqueous solution of the silver salt and the aqueous solution of the halide are mixed with each other.

The fine-grained silver halide emulsion obtained by the present invention can be used as nuclei in the crystal growth of the silver halide grains. When the grains are utilized for the crystal growth, it is preferred that the silver halide grains added are rapidly dissolved. Accordingly, less twin crystal nuclei are preferred, and it is preferred that the aqueous solution of gelatin has a higher concentration. The concentration of the aqueous solution of gelatin is adjusted to such a concentration that preferably 0.2 g to 1 g, more preferably 0.3 g or more, and most preferably 0.4 g or more, of gelatin is added per gram of silver nitrate added.

When the concentration of the aqueous solution of gelatin is increased, the viscosity of the aqueous solution of gelatin increases to make addition thereof difficult. Decreasing the molecular weight of gelatin by techniques such as enzymolysis can decrease the viscosity. The molecular weight of gelatin is preferably from 5,000 to 100,000, more preferably 50,000 or less, and most preferably 30,000 or less.

When utilized for the crystal growth, gelatin added together with the silver halide grains has an effect on the thickness of the tabular silver halide grains. The effect on the thickness can be variously changed by chemical modification. For obtaining thin tabular silver halide grains, oxidation treatment, succination treatment and trimellitation treatment can be preferably used.

The flow rate of the solution added as the jet stream is preferably 100 m/second or more, more preferably 250 m/second or more, and most preferably 500 m/second or more.

The diameter of the capillary in which the solutions are mixed with each other is preferably 20 times or less, more preferably 10 times or less, and most preferably 7 times or less, the diameter of an opening for adding the linear jet stream.

The length of the capillary in which the solutions are mixed with each other is preferably 10 times or more, more preferably 50 times or more, and most preferably 100 times or more, the diameter thereof.

The capillary has at least one recess on the inside. When the solution added flows through the capillary, the recess converts the flow to finer turbulence to cause more homogeneous mixing.

When mixing is conducted by the jet stream having a high flow rate, the temperature of the mixed solution is elevated. It is therefore preferred that the apparatus is equipped with a cooler.

The aqueous solution of the silver salt and the aqueous solution of the halide are preferably mixed with each other for a short time. The mixing time is preferably 0.5 second or less, more preferably 0.1 second or less and most preferably 0.05 second or less.

When the aqueous solution of the silver salt and the aqueous solution of the halide are mixed with each other, it is preferred that the circulation of the added solutions does not occur in the external mixer. In the case that the added solutions circulate in the external mixer, the growth of the resulting fine silver halide grains is unfavorably liable to occur.

It is preferred that the mixing of the aqueous solution of the silver salt and the aqueous solution of the halide is not accompanied by mechanical stirring. When the mixing is accompanied by the mechanical stirring, it is difficult to mix the solutions without the circulation. Further, when the mixing time is as short as 0.1 second or less, it is difficult to sufficiently mix the solutions by the mechanical stirring.

Mixing methods satisfying the requirements of the present invention include a method using a high pressure homogenizer (DeBEE 2000) manufactured by BEE INTERNATIONAL Co. Using the dual field process of the homogenizer, one of the aqueous solution of the silver salt and the aqueous solution of the halide is turned into a high speed jet stream, which can be mixed with the other solution. The application of high pressure to the aqueous solution to be turned into the jet stream gives high kinetic energy to the solution, which makes it possible to mix the two solutions with each other for an extremely short time. According to this method, the circulation that the solution added return to the vicinity of the addition opening again is not generated, and further, the mechanical stirring is not required because the added solution has sufficient kinetic energy.

EXAMPLES

The present invention will be described with reference to the following examples.

EXAMPLE 1

(COMPARISON)

An aqueous solution of silver nitrate and an aqueous solution of silver bromide containing gelatin were added to the stirrer described in JP-A-10-43570 to form fine silver bromide grains. In the mixer, mixing was carried out by mechanical stirring. A 0.0826 mol/liter aqueous solution of silver nitrate and a 0.0836 mol/liter aqueous solution of potassium bromide containing low-molecular weight gelatin (molecular weight: 20,000) in a concentration of 0.350% were each added into a cell at a flow rate of 200 cc/minutes. The residence time of the added solutions in the mixing vessel was 2.3 seconds.

The fine silver halide grains formed were observed under a transmission electron microscope. For preventing the fine silver halide grains from being damaged by the electron beam, the sample was cooled to −120° C. using liquid nitrogen. The fine silver halide grains observed were approximately spherical. For 300 grains, the size was measured. As a result, the average diameter was 16.2 nm, and the coefficient of variation was 33%.

(INVENTION)

By using a high pressure homogenizer (DeBEE 2000) manufactured by BEE INTERNATIONAL Co. as a mixer, an aqueous solution of silver nitrate and an aqueous solution of silver bromide containing gelatin were mixed with each other to form fine silver bromide grains. Using the dual field process of the apparatus, a 0.0826 mol/liter aqueous solution of silver nitrate was turned into a linear jet stream. The jet stream was formed by passing the solution through a nozzle having a diameter of 0.1 mm under an extrusion pressure of $9.8\times10^7$ Pa. The addition speed of the aqueous solution of silver nitrate was 280 cc/minute, and the flow rate thereof was 600 m/second. An aqueous solution of potassium bromide containing gelatin was added through the other addition opening while controlling the flow rate with a piston. The concentration of potassium bromide was 0.0836 mol/liter, and the concentration of the aqueous solution of gelatin was 0.350%. As the gelatin, low-molecular weight gelatin having a molecular weight of about 20,000 was used. The addition speed was 280 cc/minute. The aqueous solution of silver nitrate and the aqueous solution of the halide were mixed with each other for a mixing time of 0.012 second without circulation and mechanical stirring by this method. The average diameter of the resulting fine silver halide grains was 13.8 nm, and the coefficient of variation was 24%.

The above indicates that the formation of fine silver halide grains small in size and excellent in mono-dispersibility is possibleby the present invention. By using the fine grains as nuclei, the preparation of silver halide photographic emulsions excellent in monodispersibility becomes possible.

EXAMPLE 2

(EMULSION A/COMPARISON)

An aqueous solution (34.3 liters) containing 26.4 g of KBr and 65.9 g of low-molecular weight, oxidized gelatin (alkali-treated ossein gelatin in which methionine groups were oxidized and its molecular weight was reduced with an enzyme, methionine group content: 4 μmol/g, average molecular weight: 15,000) was maintained at 35° C., and stirred. (Preparation of 1st Solution)

Aqueous solution Ag-1 (containing 4.9 g of $AgNO_3$ in 100 ml) (2005 ml), 1530 ml of aqueous solution X-1 (containing 5.2 g of KBr in 100 ml) and 448 ml of an aqueous solution of gelatin (containing 8.0 g of the above-mentioned low-molecular weight, oxidized gelatin in 100 ml) were added by the triple jet process at a constant flow rate for 30 seconds. (Addition 1) Thereafter, 171 g of KBr was added, and the temperature was elevated to 75° C. After the temperature was elevated, the resulting solution was subjected to a ripening process for 12 minutes, followed by addition of 7900 ml of an aqueous solution of gelatin (containing 12.7 g of alkali-treated ossein gelatin in 100 ml, in which methionine groups were oxidized). Then, 55.3 g of disodium 4,5-dihydroxy-1,3-disulfonate monohydrate and 0.05 g of thiourea dioxide were in turn added at intervals for every 1 minute.

Then, 13358 ml of aqueous solution Ag-2 (containing 32 g of $AgNO_3$ in 100 ml) and aqueous solution X-2 (containing 22.0 g of KBr and 1.1 g of KI in 100 ml) were added by the double jet process for 46 minutes. At this time, Ag-2 was added at a constant flow rate, and aqueous solution X-2 was added so that the bulk emulsion solution in the reaction vessel was maintained at a pAg of 7.86. (Addition 3)

Further, 4114 ml of aqueous solution Ag-4 (containing 32.0 g of $AgNO_3$ in 100 ml) and aqueous solution X-4 (containing 22.4 g of KBr in 100 ml) were added by the double jet process for 17 minutes. At this time, aqueous solution Ag-4 was added at a constant flow rate, and aqueous solution X-3 was added so that the bulk emulsion solution in the reaction vessel was maintained at a pAg of 7.52. (Addition 4)

Thereafter, 1.8 g of sodium benzenethiosulfonate and 3297 ml of an aqueous solution of ossein gelatin (containing 12.0 g of alkali-treated ossein gelatin in 100 ml) were in turn added at intervals for every 1 minute. Then, KBr was added so that the bulk emulsion solution in the reaction vessel gave a pAg of 9.00, followed by addition of 1950 g of a fine AgI grain emulsion (containing 13.0 g of fine AgI grains having an average grain size of 0.047 μm in 100 ml). From 2 minutes after that, 6567 ml of aqueous solution Ag-4 and aqueous solution X-4 were added by the double jet process. At this time, aqueous solution Ag-4 was added at a constant flow rate for 9 minutes. Only for the first 3.3 minutes, aqueous solution X-4 was added so that the bulk emulsion solution in the reaction vessel was maintained at a pAg of 9.00, and for the remaining 5.7 minutes, it was not added. Thus, the pAg of the bulk emulsion solution in the reaction vessel was finally adjusted to 8.4. (Addition 5)

Thereafter, desalting was conducted by the flocculation method, and then, water, NaOH and gelatin-1 described above were added with stirring to adjust the solution to pH 6.4 and pAg 8.6 at 56° C.

The resulting grains were tabular silver halide grains in which (111) planes were main planes. The average circle corresponding diameter thereof was 1.46 μm, and the average thickness thereof was 0.15 μm. These grains were observed under a transmission electron microscope. As a result, 30 or more transition lines per grain were observed on fringe (edge) portions of the grains on average.

(EMULSION B/COMPARISON)

An emulsion was prepared in the same manner as with Comparison 1 with the exception that aqueous solution Ag-2 and aqueous solution X-2 of Addition 2 were mixed with each other using a stirrer described in JP-A-10-43570, and a silver halide emulsion containing ultrafine silver iodide grains having an average size of 0.033 μm thus formed was added immediately after extrusion. At this time, aqueous solution X-2 was added in an amount of 13558 ml at a constant flow rate, and the pAg of the bulk solution was maintained at 7.86 while adding X-1.

The resulting grains were a mixture of tabular silver halide grains in which (111) planes were main planes and fine normal crystal grains having a size of about 0.06 μm. As a result, the fine silver halide grains added in Addition 2 partly remained undissolved. The tabular grains had an average circle corresponding diameter of 1.69 μm and an average thickness of 0.08 μm.

(EMULSION C/INVENTION)

An emulsion was prepared in the same manner as with Comparison 2 with the exception that DeBEE 2000 was used as a mixer in place of the stirrer described in JP-A-10-43570. The average size of fine grains formed with DeBEE 2000 was 0.016 μm.

The resulting grains were tabular silver halide grains in which (111) planes were main planes, and fine normal crystal grains were scarcely observed. The tabular grains had an average circle corresponding diameter of 1.91 μm and an average thickness of 0.08 μm. These grains were observed under a transmission electron microscope. As a result, 30 or more transition lines per grain were observed on fringe (edge) portions of the grains on average.

According to the invention, the formation of the tabular grains having thin thickness and containing a few residual fine grains became possible.

EXAMPLE 3

Each emulsion was subjected to chemical sensitization and spectral sensitization in the same manner as with Example 1 of JP-A-5-346631, and compared in photographic performance. Emulsion C provided higher photographic sensitivity than emulsion A, because emulsion C could adsorb a sensitizing dye in large amounts. A large number of fine grains remained in emulsion B, so that high photographic sensitivity was not obtained.

According to the present invention, the formation of fine silver halide grains small in size and excellent in monodispersibility becomes possible. By using the fine grains for nucleation or crystal growth, the preparation of monodisperse silver halide photographic emulsions or thin tabular silver halide photographic emulsions becomes possible.

While the invention has been described in detail and with reference to specific embodiments thereof, it will be apparent to one skilled in the art that various changes and modifications can be made therein without departing from the spirit and scope thereof.

What is claimed is:

1. A method for producing a silver halide photographic emulsion comprising turning at least one of an aqueous solution of a silver salt and an aqueous solution of a halide into a linear jet stream having a flow rate of at least 250 m/sec, and mixing said two kinds of solutions with each other either: (a) for a short time; (b) without their circulation; or (c) without mechanical stirring, thereby continuously forming silver halide grains.

2. A method for producing a silver halide photographic emulsion according to claim 1, comprising turning at least one of an aqueous solution of a silver salt and an aqueous solution of a halide into a linear jet stream having a high flow rate, and mixing said two kinds of solutions with each other without their circulation, thereby continuously forming silver halide grains.

3. A method for producing a silver halide photographic emulsion according to claim 1, comprising turning at least one of an aqueous solution of a silver salt and an aqueous solution of a halide into a linear jet stream having a high flow rate, and mixing said two kinds of solutions with each other without mechanical stirring, thereby continuously forming silver halide grains.

4. A method for producing a silver halide photographic emulsion according to claim 1, comprising turning at least one of an aqueous solution of a silver salt and an aqueous solution of a halide into a linear jet stream having a high flow rate, and passing said two kinds of solutions through a capillary parallel to said jet stream and having at least one recess on the inside thereof to mix them with each other without their circulation, thereby continuously forming silver halide grains.

5. A method for producing a silver halide photographic emulsion according to claim 1, comprising turning at least one of an aqueous solution of a silver salt and an aqueous solution of a halide into a linear jet stream having a high flow rate, and passing said two kinds of solutions through a capillary parallel to said jet stream and having at least one recess on the inside thereof to mix them with each other without mechanical stirring, thereby continuously forming silver halide grains.

6. The method for producing a silver halide photographic emulsion as claimed in claim 1, wherein the aqueous solution of the silver salt or the aqueous solution of a halide has a concentration of up to 4 mol/liter to produce nuclei of silver halide grains.

7. The method for producing a silver halide photographic emulsion as claimed in claim 1, wherein the aqueous solution the silver salt or the aqueous solution of a halide has a concentration of up to 0.2 mol/liter to produce nuclei of silver halide grains.

8. The method for producing a silver halide photographic emulsion as claimed in claim 1, wherein the aqueous solution the silver salt or the aqueous solution of a halide has a concentration of 0.5 mol/liter to 4 mol/liter to produce silver halide grains for crystal growth.

9. The method for producing a silver halide photographic emulsion as claimed in claim 1, wherein the aqueous solution the silver salt or the aqueous solution of a halide has a concentration of at least 1.0 mol/liter to produce silver halide grains for crystal growth.

10. The method for producing a silver halide photographic emulsion as claimed in claim 1, wherein at least one of the aqueous solution the silver salt and the aqueous solution of the halide comprises gelatin at a concentration of 0.03 to 0.4 g per gram of silver to produce parallel double twin crystal nuclei of silver halide grains.

11. The method for producing a silver halide photographic emulsion as claimed in claim 1, wherein at least one of the aqueous solution the silver salt and the aqueous solution of the halide comprises gelatin at a concentration of up to 0.3 g per gram of silver to produce parallel double twin crystal nuclei of silver halide grains.

12. The method for producing a silver halide photographic emulsion as claimed in claim 1, wherein an aqueous solution silver nitrate comprises gelatin at a concentration of 0.2 g to 1 g per gram of silver nitrate to produce nuclei in the crystal growth of silver halide grains.

13. The method for producing a silver halide photographic emulsion as claimed in claim 1, wherein an aqueous solution silver nitrate comprises gelatin at a concentration of at least 0.3 g per gram of silver nitrate to produce nuclei in the crystal growth of silver halide grains.

14. The method for producing a silver halide photographic emulsion as claimed in claim 1, wherein an aqueous solution silver nitrate comprises gelatin at a concentration of at least 0.4 g per gram of silver nitrate to produce nuclei in the crystal growth of silver halide grains.

15. The method for producing a silver halide photographic emulsion as claimed in claim 1, wherein the aqueous solution of a silver salt or an aqueous solution of a halide comprises gelatin having a molecular weight of 5,000 to 100,000.

16. The method for producing a silver halide photographic emulsion as claimed in claim 1, wherein the aqueous solution of a silver salt or an aqueous solution of a halide comprises gelatin having a molecular weight of up to 30,000.

17. The method for producing a silver halide photographic emulsion as claimed in claim 1, wherein the solution added as the jet stream has a flow rate of at least 500 m/second.

18. The method for producing a silver halide photographic emulsion as claimed in claim 1, wherein the mixing time is up to 0.5 second.

19. The method for producing a silver halide photographic emulsion as claimed in claim 1, wherein the mixing time is up to 0.05 second.

20. A method for producing a silver halide photographic emulsion according to claim 1, comprising turning at least one of an aqueous solution of a silver salt and an aqueous solution of a halide into the linear jet stream and mixing said two kinds of solutions with each other for a short time, thereby continuously forming silver halide grains.

21. A method for producing a silver halide photographic emulsion according to claim 1, comprising turning at least one of an aqueous solution of a silver salt and an aqueous solution of a halide into the linear jet stream and passing said two kinds of solutions through a capillary parallel to said jet stream and having at least one recess on the inside thereof to mix them with each other for a short time, thereby continuously forming silver halide grains.

22. A method for producing a silver halide photographic emulsion comprising turning at least one of an aqueous solution of a silver salt and an aqueous solution of a halide into a linear jet stream having a flow rate of at least 250 m/sec, and passing said two kinds of solutions through a capillary parallel to said jet stream and having at least one recess on the inside thereof to mix them with each other either: (a) for a short time; (b) without their circulation; or (c) without mechanical stirring, thereby continuously forming silver halide grains.

23. The method for producing a silver halide photographic emulsion as claimed in claim 22, wherein the aqueous solution the silver salt or the aqueous solution of a halide has a concentration of up to 4 mol/liter to produce nuclei of silver halide grains.

24. The method for producing a silver halide photographic emulsion as claimed in claim 22, wherein the aqueous solution the silver salt or the aqueous solution of a halide has a concentration of up to 0.2 mol/liter to produce nuclei of silver halide grains.

25. The method for producing a silver halide photographic emulsion as claimed in claim 22, wherein the aqueous solution the silver salt or the aqueous solution of a halide has a concentration of 0.5 mol/liter to 4 mol/liter to produce silver halide grains for crystal growth.

26. The method for producing a silver halide photographic emulsion as claimed in claim 22, wherein the aqueous solution the silver salt or the aqueous solution of a halide has a concentration of at least 1.0 mol/liter to produce silver halide grains for crystal growth.

27. The method for producing a silver halide photographic emulsion as claimed in claim 22, wherein at least one of the aqueous solution the silver salt and the aqueous solution of the halide comprises gelatin at a concentration of 0.03 to 0.4 g per gram of silver to produce parallel double twin crystal nuclei of silver halide grains.

28. The method for producing a silver halide photographic emulsion as claimed in claim 22, wherein at least one of the aqueous solution the silver salt and the aqueous solution of the halide comprises gelatin at a concentration of up to 0.3 g per gram of silver to produce parallel double twin crystal nuclei of silver halide grains.

29. The method for producing a silver halide photographic emulsion as claimed in claim 22, wherein an aqueous solution silver nitrate comprises gelatin at a concentration of 0.2 g to 1 g per gram of silver nitrate to produce nuclei in the crystal growth of silver halide grains.

30. The method for producing a silver halide photographic emulsion as claimed in claim 22, wherein an aqueous solution silver nitrate comprises gelatin at a concentration of 0.2 g to 1 g per gram of silver nitrate to produce nuclei in the crystal growth of silver halide grains.

31. The method for producing a silver halide photographic emulsion as claimed in claim 22, wherein an aqueous solution silver nitrate comprises gelatin at a concentration of at least 0.4 g per gram of silver nitrate to produce nuclei in the crystal growth of silver halide grains.

32. The method for producing a silver halide photographic emulsion as claimed in claim 22, wherein the aqueous solution of a silver salt or an aqueous solution of a halide comprises gelatin having a molecular weight of 5,000 to 100,000.

33. The method for producing a silver halide photographic emulsion as claimed in claim 22, wherein the aqueous solution of a silver salt or an aqueous solution of a halide comprises gelatin having a molecular weight of up to 30,000.

34. The method for producing a silver halide photographic emulsion as claimed in claim 22, wherein the solution added as the jet stream has a flow rate of at least 500 m/second.

35. The method for producing a silver halide photographic emulsion as claimed in claim 22, wherein the mixing time is up to 0.5 second.

36. The method for producing a silver halide photographic emulsion as claimed in claim 22, wherein the mixing time is up to 0.05 second.

* * * * *